US005896114A

United States Patent [19]

Imamura et al.

[11] Patent Number: 5,896,114

[45] Date of Patent: Apr. 20, 1999

[54] MATRIX TYPE DISPLAY DEVICE, ELECTRONIC SYSTEM INCLUDING THE SAME AND METHOD OF DRIVING SUCH A DISPLAY DEVICE

[75] Inventors: Yohichi Imamura; Shigeki Aoki; Norio Koizumi, all of Suwa, Japan

[73] Assignee: Seiko Epson Corporation, Tokyo, Japan

[21] Appl. No.: 08/970,611

[22] Filed: Nov. 14, 1997

Related U.S. Application Data

[62] Division of application No. 08/337,492, Nov. 8, 1994, Pat. No. 5,742,271.

[30] Foreign Application Priority Data

Nov. 11, 1993 [JP] Japan ..... 5-282720

[51] Int. Cl.[6] ..... G09G 3/20

[52] U.S. Cl. ..... 345/55; 345/145

[58] Field of Search ..... 345/116, 55, 59, 345/98, 61, 63, 145, 23, 141, 133

[56] References Cited

U.S. PATENT DOCUMENTS

| | | | |
|---|---|---|---|
| 3,868,673 | 2/1975 | Mau, Jr. et al. | 345/145 |
| 4,237,459 | 12/1980 | Cordova | 345/59 |
| 4,365,242 | 12/1982 | Yasuda et al. | 345/145 |
| 4,395,709 | 7/1983 | Nagae et al. . | |
| 4,498,079 | 2/1985 | Ghosh et al. . | |
| 4,812,837 | 3/1989 | Shiraishi et al. . | |
| 4,992,782 | 2/1991 | Sakamoto et al. . | |
| 5,241,304 | 8/1993 | Munetsugu et al. . | |
| 5,264,839 | 11/1993 | Kanno et al. . | |
| 5,291,185 | 3/1994 | Yoshimura . | |
| 5,473,341 | 12/1995 | Tomiyasu . | |

*Primary Examiner*—Regina Liang
*Attorney, Agent, or Firm*—Oliff & Berridge, PLC

[57] ABSTRACT

The present invention provides a matrix type display device which simplifies the process in a display signal generating circuit while relieving the load on an external CPU, and which arranges freely character and icon display areas while preventing the quality of display from being degraded by the shadow phenomenon and others. A display code memory stores character display codes and icon display codes for one image at a desired address arrangement. A pattern generating circuit transfers image patterns for the display codes to a display signal transferring circuit through a multiplexer. A decoder selecting device is responsive to a decoder select signal to select a decoder, thereby controlling voluntarily the timing of latch signal generation. Display signal input in the time division manner is latched in first and second latch circuits through the latch signal. Thereafter, the display signal is transferred to a signal electrode driving circuit through a line memory to display an image on a matrix panel.

6 Claims, 14 Drawing Sheets

| FIG.3A | FIG.3B |
|---|---|

FIG. 9A

UNIT (%)

| ITEMS | LETTERS | S1 | S2 | S3 | S4 | S5 |
|---|---|---|---|---|---|---|
| NUMERALS | 0 ~ 9 | 37.1 | 40.0 | 45.7 | 45.7 | 40.0 |
| ENGLISH CAPITAL LETTERS | A ~ Z | 74.1 | 24.7 | 35.7 | 29.1 | 51.6 |
| ENGLISH SMALL LETTERS | a ~ z | 43.4 | 30.8 | 33.0 | 26.9 | 36.8 |
| AVERAGE | | 53.3 | 29.7 | 36.2 | 30.9 | 43.5 |

FIG. 9B

UNIT (%)

| ITEMS | LETTERS | C1 | C2 | C3 | C4 | C5 | C6 | C7 |
|---|---|---|---|---|---|---|---|---|
| NUMERALS | 1 ~ 9 | 52.0 | 32.0 | 36.0 | 42.0 | 36.0 | 30.0 | 54.0 |
| ENGLISH CAPITAL LETTERS | A ~ Z | 60.8 | 35.4 | 33.8 | 49.2 | 36.2 | 33.8 | 51.5 |
| ENGLISH SMALL LETTERS | a ~ z | 8.5 | 9.2 | 53.1 | 40.0 | 45.4 | 33.8 | 50.8 |
| AVERAGE | | 39.0 | 23.9 | 42.3 | 44.2 | 40.0 | 33.2 | 51.6 |

CPU
DISPLAY CODE MEMORY
CHAR-ACTER PATTERN GENER-ATOR
MULTI-PLEX-ER
ICON DISPLAY MEMORY
SCAN ELEC-TRODE DRIVE
SIGNAL ELECTRODE DRIVE
DISPLAY SIGNAL TRANSFER
C1
C2
C3
C4
C5
C6
C7
Cm-6
Cm-5
Cm-4
Cm-3
Cm-2
Cm-1
Cm
CS
S1
S2
S3
S4
S5
Sn
Sn-1
Sn-2
Sn-3
Sn-4
110
111
112
113
114
115
116
117
118
119
120
121
122
123
124
125
126
140
142
144

MATRIX TYPE DISPLAY DEVICE, ELECTRONIC SYSTEM INCLUDING THE SAME AND METHOD OF DRIVING SUCH A DISPLAY DEVICE

This is a Division of application Ser. No. 08/337,492 filed Nov. 8, 1994 now U.S. Pat. No. 5,742,271.

BACKGROUND OF THE INVENTION

1. Field of the Invention

The present invention relates to a matrix type display device, an electronic system including the same and a method of driving such a display device. Particularly, the present invention concerns a matrix type display device which can display characters and icons.

2. Description of the Related Art

As for a simple matrix type display device, a built-in RAM is known. In such a display device, the display is carried out by transferring display data for one image from the CPU or the like to the built-in RAM, and sequentially reading display data for one scan line from the built-in RAM. If the image on display remains the same as in a still image, the display data transfer from the CPU is unnecessary and the display operation can be carried out only by the display data from the built-in RAM, thus reducing the power consumption.

Another matrix type display device with a character pattern generator is known. In addition to the built-in RAM in such a matrix type display device, the display is performed by transferring character codes for one image from the CPU or the like to the built-in RAM, and converting the character codes into dot image display data through the character pattern generator. This matrix type display device can operate with a reduced power consumption and be controlled easily. Therefore, such a matrix type display device has been broadly used in many portable electronic devices such as portable telephones, electronic pocketbooks and others.

Such a matrix type display device with a character pattern generator is required to provide a function of displaying icons such as indicators, symbols and others in addition to the characters. If such icons can be displayed, for example, a portable telephone can display an indicator showing the residue of batteries, the radio field intensity, a symbol representing a telephone or the like.

FIG. 13 shows a matrix type display device with a character pattern generator which is constructed in accordance with the prior art and which can display icons. The matrix type display device comprises a matrix panel 116, a scan electrode driving circuit 110, a signal electrode driving circuit 111, a display signal transferring circuit 126 and a display signal generating circuit 140. The matrix panel 116 includes display pixels arranged in a matrix, and a plurality of signal electrodes crossing a scan electrode, the number of dots being n×(m+1). Over the matrix panel 116, a character display area 142 (which includes crossing areas between signal electrodes S1–Sn and scan electrodes C1–Cm) and an icon display area 144 (which includes crossing areas between the signal electrodes S1–Sn and a scan electrode CS) are provided. For example, if one character is to De displayed by 5×7 dots, it is possible to display characters equal to (n/5)×(m/7) as well as icons equal to n. The display signal generating circuit 140 includes a display code memory 114 for storing display codes for one image(display image), a character pattern generating circuit 113 for generating a character pattern of dot image for the display codes, an icon display memory 115 for storing an icon pattern of dot image and a multiplexer 112 for multiplexing the output of the character pattern generating circuit 113 and the icon display memory 115 to form an output display signal 123. The display signal transferring circuit 126 transfers the display signal 123 to the signal electrode driving circuit 111. The signal electrode driving circuit 111 and the scan electrode driving circuit 110 form signals for driving the signal electrodes and the scan electrodes, respectively.

The operation of the prior art is explained hereafter. The characters are displayed through the following operation. First, character codes of a character to be displayed are written in the display code memory 114 at a desired address layout. The display code memory 114 is not rewritten unless any changes are made to the displayed image, and thus reducing the power consumption. Then a character code signal 120 is read out from the display code memory 114 responding to a read-out signal 118, and is transferred to the character pattern generating circuit 113. The character pattern generating circuit 113 responds to the character code signal 120 to generate a character pattern display signal 121 which is transferred to the signal electrode driving circuit 111 through the multiplexer 112 and display signal transferring circuit 126.

On the other hand, icons such as indicators, symbols and others are displayed by the following manner. First, a pattern of dot image for an icon to be displayed is written in the icon display memory 115 through the CPU or the like. The icon display memory 115 then responds to a read-out signal 118 for an icon pattern display signal 122 to be read out therefrom. The icon pattern display signal 122 is then transferred to the signal electrode driving circuit 111 through the multiplexer 112 and the display signal transferring circuit 126.

The multiplexer 112 responds to a select signal 119 to select either the character pattern signal 121 or the icon pattern display signal 122. The selected signal, signals 121 or 122, is multiplexed to be a display signal 123. In other words, the signals 121, 122 are transferred as the display signal 123 to the display signal transferring circuit 126 through the multiplexer 112 within one horizontal period in the time division manner. The display signal transferring circuit 126 accumulates the display signal 123 as data for each pixel line and transfer the data to the signal electrode driving circuit 111. Such a transfer is carried out for every horizontal period. The signal electrode driving circuit 111 outputs liquid-crystal drive voltages corresponding to the transferred display signal to the signal electrodes S1–Sn. On the other hand, the scan electrode driving circuit 110 responds to a scan control signal 117 to scan the scan electrodes C1–Cm and CS sequentially for each horizontal period. In other words, the display signal transferring circuit 126 receives and stores the display signal 123 for the scan electrode C1 before the scan electrode C1 is scanned. As the scan electrode C1 is scanned, the circuit 126 outputs liquid-crystal drive voltages corresponding to the stored display signal 123 to the signal electrodes S1–Sn to display one pixel line. During this horizontal period, the circuit 126 receives another display signal 123 for the next scan electrode C2. Since the scan electrode CS is only used to display icons, the display signal 123 for the scan electrode CS includes only the icon pattern display signal 122, but not the character pattern display signal 121. In such a manner, the sequentially scanned scan electrodes and the signal electrodes to which the drive voltages corresponding to the display signal are applied to perform together the display operation in the matrix type display device.

However, the aforementioned matrix type display device of the prior art has many disadvantages.

First, the prior art has a problem in that the processing in the display signal generating circuit 140 becomes complicated with an increased processing time. More particularly, in the prior art, the external CPU or the like must write character codes into the display code memory 114 and also dot images into the icon display memory 115. Therefore, the CPU is required to handle a combined data of character codes and dot images. This makes the process complicated and increases the burden on the CPU. It is further assumed that the data bus from the CPU is eight-bit data bus. In such a case, since one character can be specified by an eight-bit character code, only one data transfer from the CPU is necessary to display one character (e.g., 5×7 dots). On the contrary, the data of an icon must be transferred as a dot image. For example, if an icon of 5×7 dots is to be displayed, four or five data transfers are required, increasing the processing time.

Second, the prior art has a problem in that the icon display area is not freely arranged on the matrix panel 116 under the limitations of arrangement with respect to the scan electrodes and signal electrodes. For example, it an icon display area is to be provided on the right side of the character display area 142, it is necessary to extend the icon scan electrode CS, and display the icon at the areas where the extended icon scan electrode CS and the signal electrode Sn cross(see FIG. 12). Since the signal electrodes and scan electrodes are formed on the same substrate, they cannot cross one another. Therefore, a pattern of extending the scan electrode CS becomes complicated in addition to increase in the length of the extended scan electrode CS. The complicated electrode extending pattern makes the design of the matrix panel 116 difficult while the further extended scan electrode increases the parasitic resistance, and thus degrading the quality of display. Furthermore, the prior art cannot substantially display the icon in the character display area 142.

To overcome such a problem, it is possible to provide another icon display signal electrode SS on the matrix panel 116. According to such a measure, an icon can be displayed at crossing areas between the signal electrode SS and the scan electrodes C1–Cm and CS. However, providing such a signal electrode SS raises another problem in that the data transfer from the multiplexer 112 to the display signal transferring circuit 126 becomes complicated. More particularly, the character pattern generating circuit 113 usually outputs display signal (five-bit) for one character at the same time. Nevertheless, it the icon display signal electrode SS is newly provided and when display signal is to be transferred to dots on the scan electrodes C1–Cm, the multiplexer 112 must repeatedly output character display five-bit signal (n/5) times within one horizontal period before an icon display one-bit signal is output. On the other hand, when display signal is to be transferred to dots on the scan electrode CS, the multiplexer 112 must output icon display one-bit signal (n+1) times. Thus, if the icon display signal electrode SS is newly provided in the prior art, the multiplexer 112 must perform a different multiplexing operation for each scan line and handle a very complicated process.

Since the character and icon display areas are fixed in the prior art, those users who design portable telephones or the like using the matrix type display device can not rearrange freely the character and icon display areas.

Third, the prior art raises a still another problem in that it may degrade the quality of display depending on the rate of lighting-on in the character patterns. Namely, the prior art may create a shadow phenomenon (cross-talk). Such a problem is raised not only in the aforementioned matrix type display device of the prior art, but also generally in all the matrix type display devices with character pattern generators.

SUMMARY OF THE INVENTION

It is therefore an object of the present invention to simplify the process in the display signal generating circuit and also to relieve the burden on any external CPU or the like which is used to write data into the system.

Another object of the present invention is to provide a matrix type display device in which the character and icon display areas are freely re-arranged on the matrix panel.

A still another object of the present invention is to overcome a problem related to the degradation of the quality of display depending on the rate of lighting-on, that is, the shadow phenomenon (cross-talk).

To this end, the present invention provides a matrix type display device comprising a matrix panel including display pixels arranged in a matrix and a plurality of signal electrodes crossing a plurality of scan electrodes, signal electrode driving mean; for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, said display signal generating means comprising display code storage means for storing display codes for at least one image in order to store character display codes for specifying character patterns and icon display codes for specifying icon patterns in a desired address arrangement, means for generating dot image patterns for the display codes stored in said display code storage means, and means for outputting the dot image patterns as the display signal for every dot line.

According to the present invention, the character display codes and the icon display codes can be stored in a desired address arrangement. The stored display code can be used to form an image pattern which is in turn displayed on the matrix panel, and excludes a memory for icon which would be required in the prior art. According to the present invention, both characters and icons can be displayed at a desired area of the matrix panel simply by writing the character display codes and the icon display codes in the display code memory. This can relieve the burden on any external CPU or the like during the writing step. According to the present invention, it is possible to use the same format for output display data since the character data and the icon data are handled as the data of the same type in the same memory space. According to the present invention, furthermore, the characters as well as the icons can be flashed.

The present invention also provides a matrix type display device comprising a matrix panel including display pixels arranged in a matrix and a plurality of signal electrodes crossing a plurality of scan electrodes, signal electrode driving means for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, said transferring means comprising means for generating a plurality of taking-in signals for the display signal, display signal storage means responsive to said plurality of taking-in signals for storing the display signal output from said display signal generating means for each dot line within one horizontal period in the time division manner, and line memory means connected to said display signal storage means for taking in the display signal stored in said display signal storage means for each horizontal period and for transferring the taken display signal to said signal electrode driving means, said display signal storage means comprising first display signal storing means for taking in the display signal for character pattern and second display signal storing means for taking in the display signal for icon pattern, and said taking-in signal generating means comprising means for controlling generation timing of said plurality of taking-in signals.

According to the present invention, characters can be displayed on signal electrodes connected to the first display signal storing means by storing character display signal in the first display signal storing means, while icons can be displayed on signal electrodes connected to the second display signal storing means by storing icon display signal in the second display signal storing means. In such a case, different types of display signal stored in the display signal storage means can be controlled voluntarily by controlling the generation timing of the taking-in signals. Thus, characters and icons can be displayed anywhere on the matrix panel. This enables Icons to be displayed on the character display area in addition to relocating of characters.

According to the present invention, said plurality of taking-in signals are simultaneously generated for each of said second display signal storage means disposed at at least two separate locations within a predetermined part of one horizontal period under the control of said generation timing controlling means.

Thus, the same icons can be displayed at different locations or different icons can be displayed at the same timing on the matrix panel. This increases the variety of display.

The generation timing controlling means may comprise a plurality of decoder means each disposed corresponding to the respective one of said first and second display signal storage means, each of said decoder means outputting one of said plurality of taking-in signals for the display signal sequentially toward said first or second display signal storage means, and decoder selecting means for outputting a selection signal to said decoder means to select said decoder means, thereby controlling the generation timing of said plurality of taking-in signals.

Thus, any one of the decoder means can be selected by the selection signal from the decoder selecting means to control the generation timing of the taking-in signals voluntarily. For example, if the decoder selecting means is formed by ROM, RAM, EEPROM or the like, the generation timing of the taking-in signals can be controlled by changing a program stored in the ROM, RAM or the like. Thus, characters and icons can be displayed anywhere on the matrix panel. This enables the layout of character and icon display areas to be changed voluntarily. Therefore, the present invention can provide an optimum standard device.

The present invention further provides a matrix type display device comprising a matrix panel including display pixels arranged in a matrix and a plurality of signal electrodes. Crossing with a plurality of scan electrodes, signal electrode driving means for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, means for displaying an icon on said matrix panel at a crossing area between one of the signal electrodes having a lower rate of lighting-on when a character is displayed at the character display area and one of the scan electrodes disposed at the icon display area.

According to the present invention, an icon is displayed on the matrix panel at the crossing area between the respective one of the signal electrodes having the lower rate of lighting-on matrix panel and one of the scan electrodes disposed at the icon display area. Thus, it is possible to increase the rate of lighting-on in the signal electrodes and enlarge the parasitic capacity of the signal electrodes, preventing any shadow phenomenon and improving the quality of display.

The present invention further provides a matrix type display device comprising a matrix panel including display pixels arranged in a matrix and a plurality of signal electrodes crossing with a plurality of scan electrodes, signal electrode driving means for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, means for displaying an icon on said matrix panel at a crossing area between one of the scan electrodes having a lower rate of lighting-on when a character is displayed at the character display area and one of the signal electrodes disposed at the icon display area.

According to the present invention, an icon is displayed on the matrix panel at the crossing area between one signal electrode having the lower rate of lighting-on matrix panel and one of the signal electrodes disposed at the icon display area. Thus, it is possible to increase the rate of lighting-on in the signal electrodes and enlarge the parasitic capacity of the signal electrodes, preventing any shadow phenomenon and improving the quality of display.

BRIEF DESCRIPTION OF THE DRAWINGS

FIG. 9A is a view illustrating the rates of lighting-on in the signal electrodes.

FIG. 9B is a view illustrating the rates of lighting-on in the scan electrodes.

DETAILED DESCRIPTION OF THE PREFERRED EMBODIMENTS

First Embodiment

Figure 1:
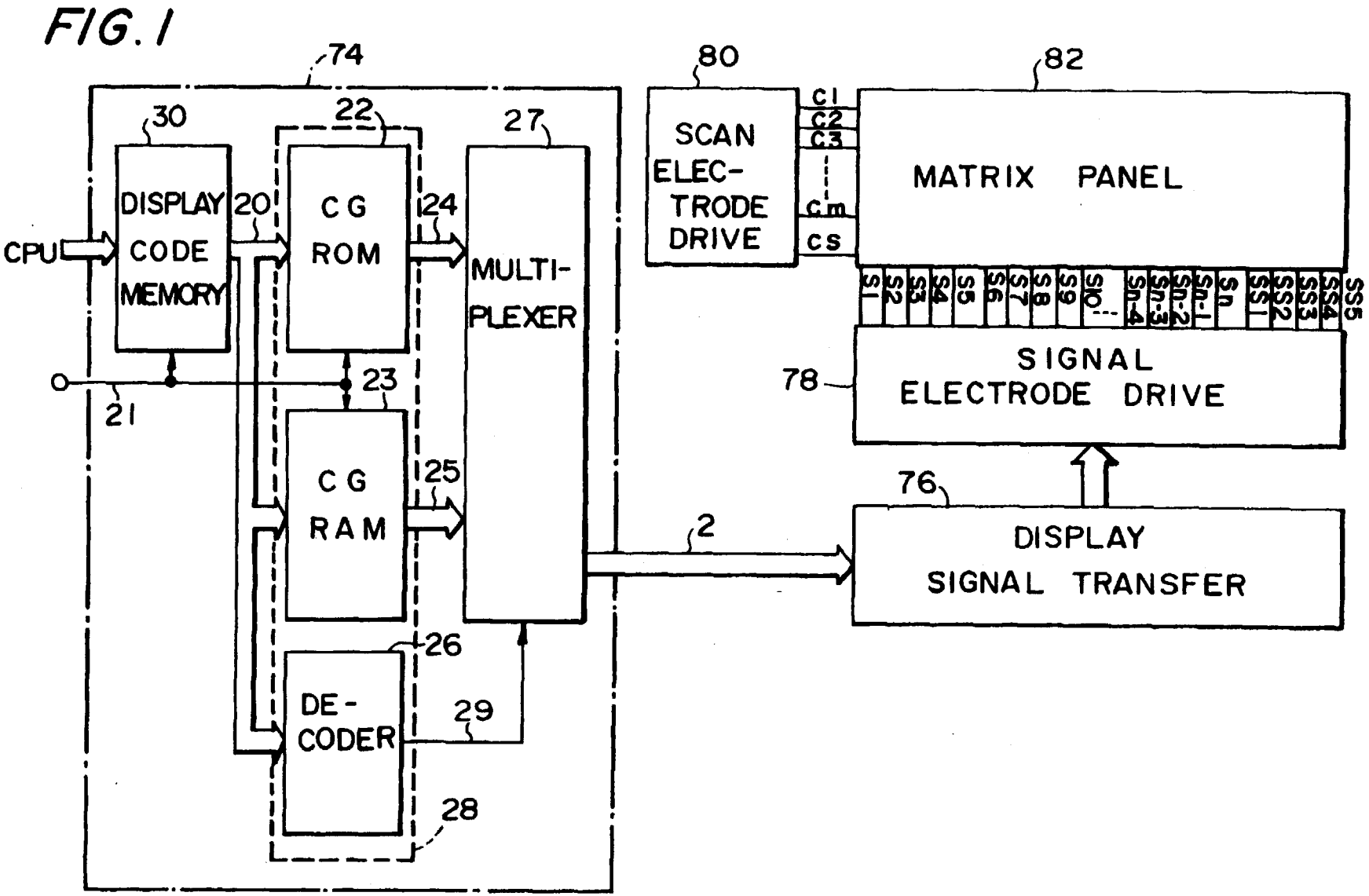
FIG. 1 is a view of a configuration of matrix type display device of the first embodiment in accordance with the present invention.

FIG. 1 shows a matrix type display device of the first embodiment according to the present invention. The matrix type display device comprises a display signal generating circuit 74, a display signal transferring circuit 76, a signal electrode driving circuit 78, a scan electrode driving circuit 80 and a matrix panel 82. The signal and scan electrode drive circuits 78, 50 apply drive voltages to signal electrodes and scan electrodes on the matrix panel 82, respectively. In this embodiment, not only an icon scan electrode CS, but also a plurality of icon signal electrodes SS1–SS5 are disposed on the matrix panel 82. The display signal transferring circuit 76 transfers a display signal 2 output from the display signal generating circuit 74 to the signal electrode driving circuit 78.

The display signal generating circuit 74 comprises a display code memory 30, a pattern generating circuit 28 and a multiplexer 27. The pattern generating circuit 28 includes a CGROM (Character Generator ROM) 22, a CGRAM (Character Generator RAM) 23 and a decoder circuit 26. The display code memory 30 stores display codes for one image (display image) at a desired address arrangement. The display codes include character and icon display codes. This is different from the display code memory of the prior art which only stores character display codes. It is possible to store display codes for two or more images in the display code memory 30 so that many images can be displayed alternately. The pattern generating circuit 28 generates dot image patterns corresponding to the display codes stored in the display code memory 30 and outputs the dot image patterns to the display signal transferring circuit 76 through the multiplexer 27 as a display signal for every dot line. In such a manner, the display signal generating circuit 74 of this embodiment handles icons in the same manner as characters. Therefore, the first embodiment does not have any icon display memory which would be used in the prior art.

On operation, an external CPU or the like first writes display codes of characters and icons to be displayed in the display code memory 30. In such a case, an user can voluntarily select a layout of characters or icons to be displayed. A read-out signal 21 is then used to output a display code signal 20 from the display code memory 30. The display code signal 20 is a read-out address signal common to the CGROM and CGRAM 22, 23 which define the pattern generating circuit 28. In other words, the CGROM and CGRAM 22, 23 share a common memory space. The display data have been stored in the CGROM and CGRAM 22, 23 as bit images. Further, the CGROM 22 stores character font data as bit images while the CGRAM 23 stores character font data and icon display data as bit images. This embodiment can also write data into the CGRAM 23 through the external CPU or the like. Thus, the user can write desired character font data and icon display data in the matrix type display device. The CGROM and CGRAM 22, 23 are responsive to the display code signal 20 to output display pattern signal 24 and 25 toward the multiplexer 27. The multiplexer 27 responds to a select signal 29 from the decoder circuit 26 to select either the display pattern signal 24 or 25 which is output as a display signal 2.

In such a case, the select signal 29 is generated by the decoder circuit 26 decoding the display code signal 20 For example, it is now assumed that the total number of patterns which can be generated by the pattern generating circuit 28 is equal to 256, the number of character display patterns stored by the CGROM and CGRAM 22, 23 being equal to 240 and 8, respectively. It is further assumed that the number of icon display patterns stored by the CGRAM 23 is equal to 8. In such a case, the address space of the pattern generating circuit 28 is occupied by CGROM from (00)H to (EF)H, CGRAM from (F0)H to (F7)H, and icon display CGRAM from (F8)H to (FE)H, according to the hexadecimal indication. Thus, the decoder circuit 26 generates the select signal 29 to select the CGROM 22 when the address is from (00)H to (EF)H and to select the CGRAM 23 when the address is the other address.

The differences between the first embodiment of the present invention and the prior art will now be described in more detail. First, the first embodiment does not require the icon display memory 115 which is a memory (or register) for icons as in the prior art. This is because the first embodiment causes the CGRAM 23 in the pattern generating circuit 28 to manage the icon display. Although the prior art respectively manages the character and icon patterns in separate memory spaces and handles as separate data, this embodiment can handle these patterns as the data of the same type.

Second, in the prior art, the external CPU or the like is required to write character code data into the display code memory 114, and to write dot image data into the icon display memory 115. On the contrary, this embodiment can display both characters and icons simply by writing the display codes into the display code memory 30. Therefore, the CPU is not required to perform any complicated writing operation, and the burden on the CPU can be relieved. For example, icon data corresponding to 5×7 dots can be written into the display code memory 30 at the same time through one writing operation. Therefore, time required to write the data can be reduced.

Third, the first embodiment uses the same format for the character and icon display patterns from the pattern generating circuit 28, since the circuit 28 handles the character and icon data as the data of the same type and manages the data in the same memory space. Thus, the multiplexer 27 can perform a simplified multiplexing process. The format in the display signal 2 from the multiplexer 27 remains the same at all times, regardless of the display signal being for characters or for icons. As a result, the display signal transferring circuit 76 can be structured easily as in the second embodiment which will be described later.

Fourth, when an icon is to be flashed, the prior art must rewrite alternately the icon pattern of dot image on lighting-on and the icon pattern of dot image on lighting-off through the CPU or the like. On the contrary, this embodiment can display the icon flashing simply by alternating an icon pattern display code on lighting-on with an icon pattern display code on lighting-off.

Figure 2:
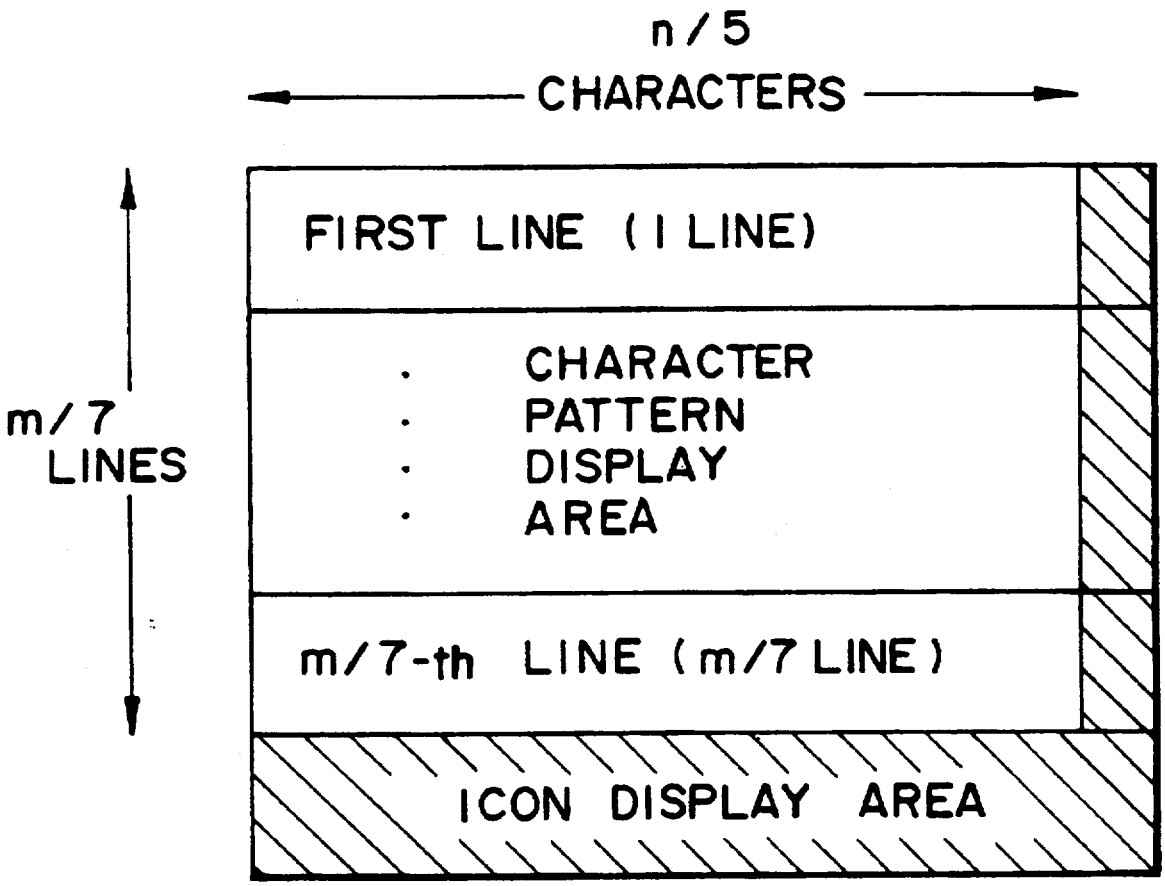
FIG. 2 is a view illustrating the structure of the display code memory.

FIG. 2 shows a configuration of display code in the display code memory 30 of the first embodiment. The display code memory 30 is a frame memory for one image on the matrix panel, and its address space corresponds to the display location on the matrix panel in the proportion of 1:1. Each of the address locations stores display codes for one character or icon. In FIG. 2, for example, (n/5) character display codes and one icon display code are stored on the first line. The similar storage are carried out for the subsequent lines from 2 to (m/7). However, the final line only stores an icon display code. By arranging the display codes in such a manner, this embodiment can display characters and icons on the matrix panel in the same layout as in the display code memory 30. The layout of characters and icons can be selected voluntarily by the user.

Second Embodiment

Figures 3, 3A:
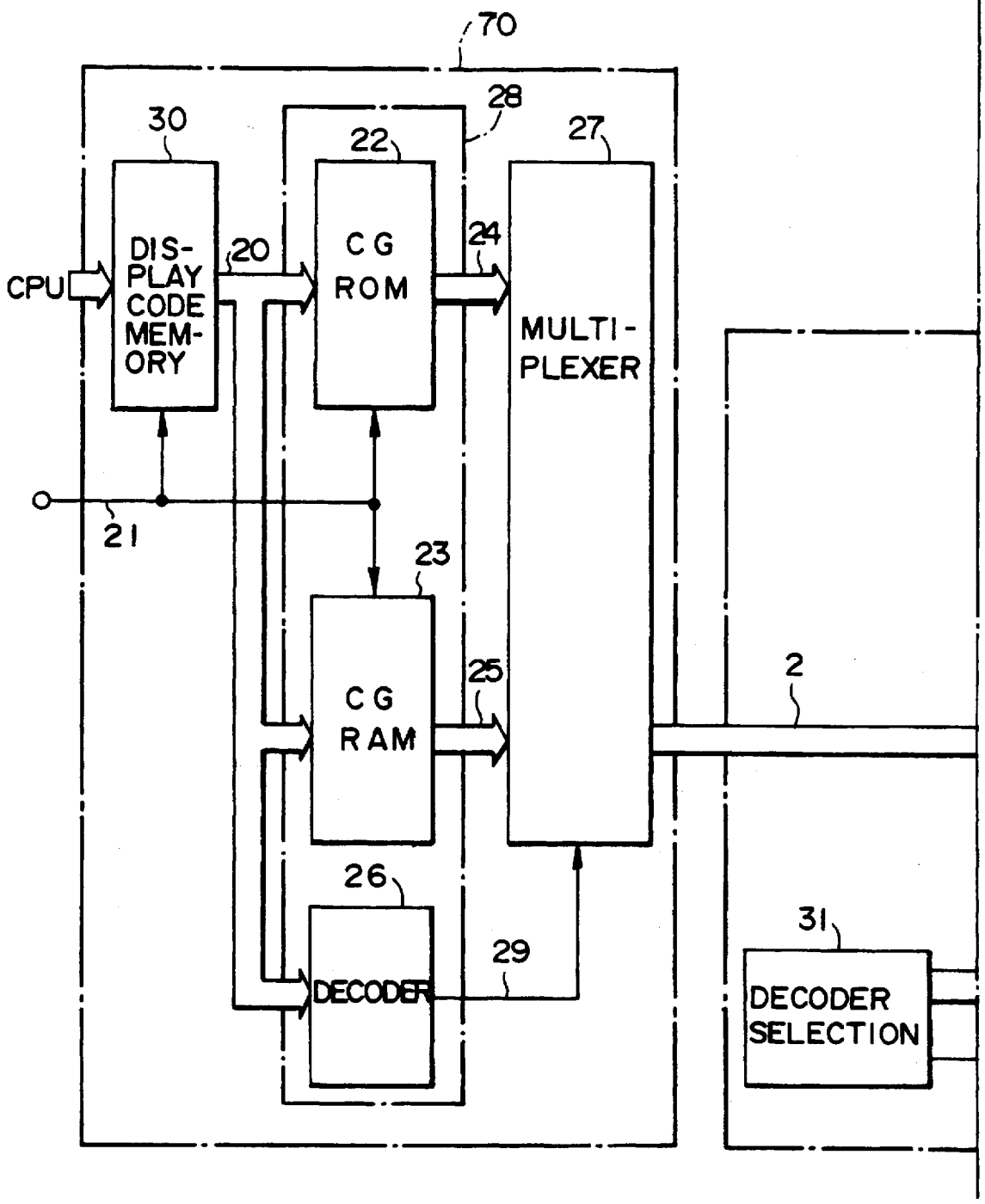
FIGS. 3A and 3B are views of a configuration of a matrix type display device of the second embodiment in accordance with the present invention.
Figure 3B:
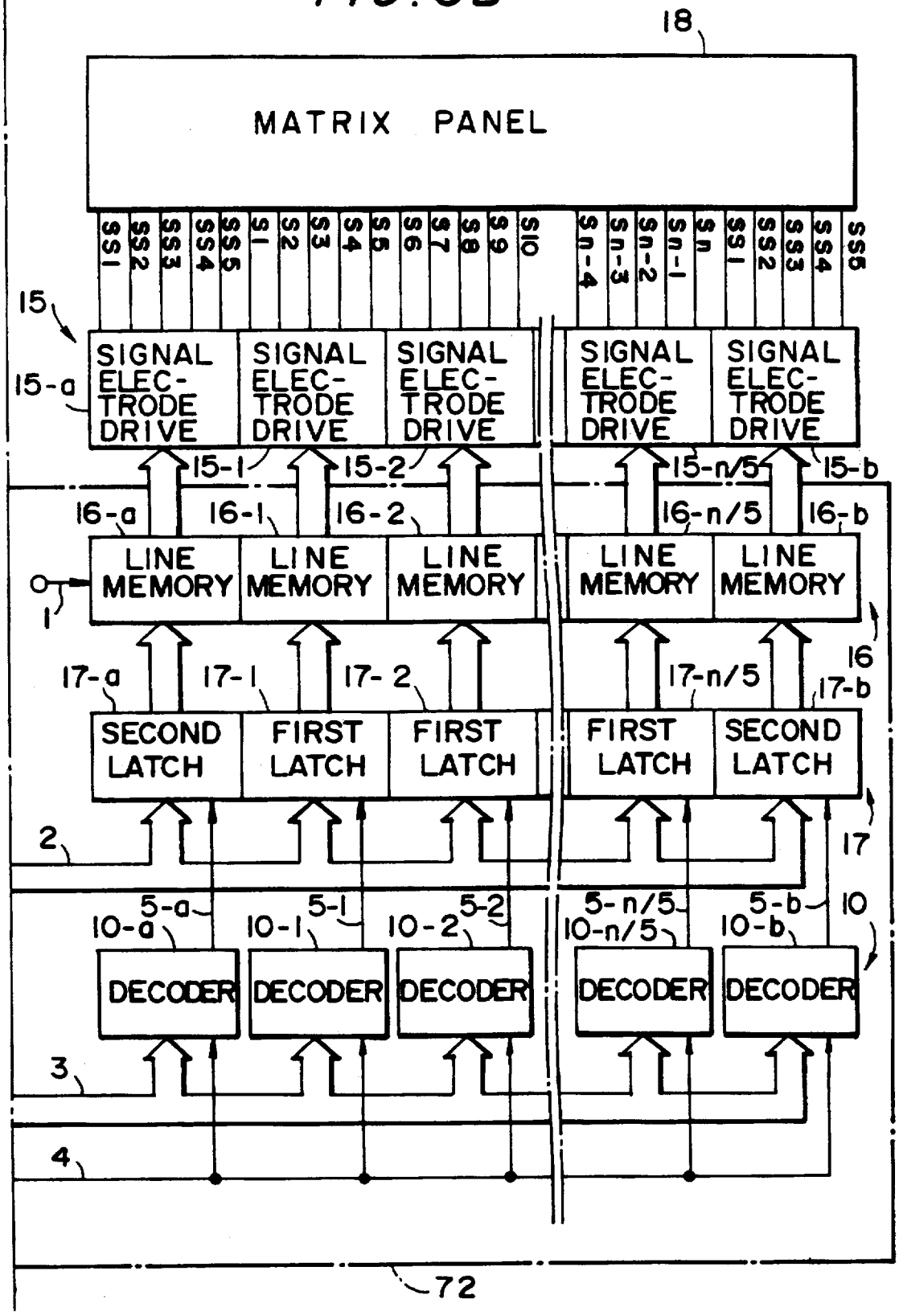

FIG. 3 shows a matrix type display device of the second embodiment according to the present invention. The second embodiment is a detailed arrangement of the display signal transferring circuit 72 while the other components such as the display signal generating circuit 70 are similar to those of the first embodiment.

The display signal transferring circuit 72 comprises a line memory 16 including line memory sections 16-1 to 16-n/5, **16-*a* and 16-*b*, a latch circuit 17 including first latches 17-1 to 17-n/5 and second latches 17-*a* and 17-*b*, a decoder circuit 10 including decoders 10-1 to 10-n/5, 10-*a* and 10-*b*, and decoder selecting means 31. FIG. 3** shows a case where one character is formed by 5×7 dots and omits the scan electrode driving circuit.

The signal electrode driving circuit 15 comprises signal electrode drives 15-1 to 15-n/5, **15-*a* and 15-*b*** and is connected to the character pattern display signal electrodes S1–Sn and icon display signal electrodes SS1–SS5. The group of signal electrodes S1–S5, S6–S10, . . . Sn–4 to Sn are of a five-bit structure while the group of icon display signal electrodes SS1–SS5 is of the same five-bit structure as in the character pattern display signal electrodes. The character pattern display signal electrodes are disposed between the icon display signal electrodes. It is assumed herein that one group of S1–S5 or others is one character group.

The signal electrode driving circuit 15 is connected to the line memory 16 which transfers a display signal taken in from the latch circuit 17 to the signal electrode driving circuit 15 within every horizontal period. Each latch in the latch circuit 17 receives a display signal 2 for each one character group in the time division manner. In such a case, the first latches 17-1 to 17-n/5 receive character pattern display signals while the second latches **17-*a* and 17-*b* receive icon pattern display signals. These latches 17 also receive latch signals 5-1 to 5-n/5, 5-*a* and 5-*b* (which will be called "latch signals 5" hereinafter) from the decoder circuit 10. The latches 17 respond to these latch signals 5 to take in the display signals 2 input in the time division manner. In this case, the generation timing of the latch signals 5 from the decoder circuit 10 is determined by decoder select signal 3 and decoder enable signal 4, all of which are the outputs of the decoder selecting means 31**.

Figure 4:
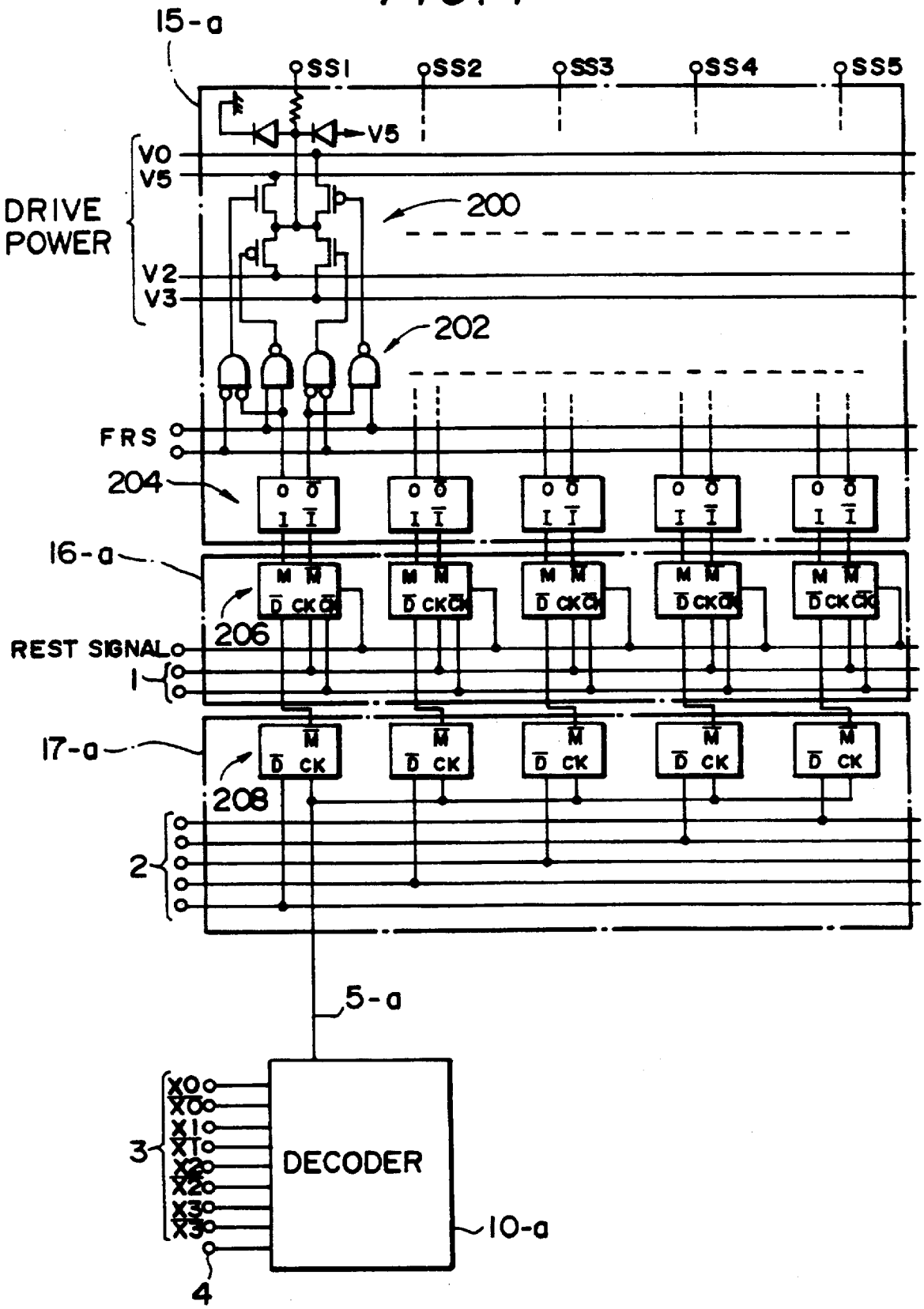
FIG. 4 is a view showing configurations of signal electrode driving circuit, line memory, latch circuit and decoder circuit.

FIG. 4 shows the details of a circuit comprising the signal electrode drive **15-*a*, the line memory section 16-*a*, the second latch 17-*a* and the decoder 10-*a* (this circuit corresponds to the signal electrodes SS1–SS5). The other circuits in the signal electrode drive circuit 15, the line memory 16, the second latch circuit 17 and the decoder circuit 10 which correspond to the other signal electrodes are similar to the above structure. AS shown in FIG. 4, the signal electrode drive 15-*a* comprises a plurality of drive power selection circuit 200 (corresponding to five bits), a logic circuit 202 and a level shift circuit 204. The signal electrode drive 15-*a* receives the output of the line memory section 16-*a*, FRS signal and drive powers V0, V2, V3 and V5 to output drive signals toward the signal electrodes SS1–SS5. The line memory 16-*a* comprises a plurality of latch circuits 206 which respond to latch signals 1 to latching the output of the second latch 17-*a*. The second latch 17-*a* comprises a plurality of latch sections 208 which respond to the latch signals 5 to take in display signals 2** of five bits (corresponding to one character).

The decoder **10-*a* receives a decoder select signal 3 of four bits (or eight bits if inverted signals are included) and decoder enable signal 4 from the decoder selecting means 31, thereby determining the generation timing of the latch signals 5-*a*. For instance, when the decoder select signal 3 is incremented from (0000) through (0001) . . . to (1111) and decoded by the decoder 10-*a*. When the decoder select signal 3 reaches a predetermined value, the decoder 10-*a* is selected to generate a latch signal 5-*a*. What value the latch signal is generated at depends on the circuit configuration of the decoder 10-*a*. If the circuit configuration of decoder 10-*a* is different from the other decoders 10-1 to 10-n/5 and 10-*b*. the generation timing of the latch signal becomes variable. For example, the decoder 10-*a* is selected to output a latch signal 5-*a* when the decoder select signal 3 is (0000) while the decoder 10-1 is selected to output a latch signal 5-1 when the decoder select signal 3 is (0001). In such a manner, the decoders are sequentially selected to generate the latch signal so that the display signals 2 input in the time division manner is taken in by the latches 17. In this embodiment, the decoder circuit 10 is of a programmable circuit with transistors connected in series. Further, it is possible to change the selection of decoders using the decoder select signal 3**, by changing the mask or the like.

On operation, first a display code is read out from the display code memory 30 on line 1 at the first column (see FIG. 2). Data is read out sequentially from the display code memory 30 at the second column, the third column, . . . and the final icon display column. Thus, Data for one pixel line (one dot line) is read out. Such a procedure is repeated seven times to read out data corresponding to lines for one character (seven lines). Data is read out sequentially from the display code memory 30 on second-character line, third-character line, . . . (m/7)th-character line and final icon display line, and then output toward the pattern generating circuit 28, thus terminating the read-out operation for one image.

On the other hand, the display signal transferring circuit 72 receives the display signals 2 from the CGROM and CGRAM 22, 23 through the multiplexer 27. The character display signals 2 are latched in the first latch 17-1 corresponding to the signal electrodes S1–S5 in response to the latch signal 5-1 which is the output of the decoder 10-1. Similarly, the other character display signals 2 are also latched in the first latches 17-2 to 17-n/5 corresponding to the signal electrodes S6–S10 to Sn-4–Sn. On the other hand, the icon display signals 2 are latched in the second latches **17-*a* and 17-*b* in response to the latch signals 5-*a* and 5-*b* which are the output of the decoders 10-*a* and 10-*b***.

All such procedures are performed within one horizontal period. Thereafter, data is transferred to the line memory sections 16 from the latches 17 by a line latch signal 1. The line memory sections 16 accumulate the data during the one horizontal period. The signal electrode driving circuit 15 outputs liquid-crystal drive voltages corresponding to the data in the line memory sections 16 to the respective signal electrodes S1–Sn and SS1–SS5 during the one horizontal period. Such an operation is repeated by the number of scan electrodes, and completes the display operation for one image.

According to the second embodiment, the decoders 10 are selected in response to the decoder select signal 3 and decoder enable signal 4 which are the output of the decoder selecting means 31 so that any signal can be transferred to any group of signal electrodes. The character and icon display areas can thus be arranged anywhere on the matrix panel 18. For example, the decoder selecting means 31 of the second embodiment may be formed by ROM, RAM, EEPROM or the like. When the program data stored in these ROM, RAM or the like is changed, the contents of the decoder select signals 3 which are the output of the decoder selecting means 31 changed. As a result, it is possible to control the generation timing of the latch signals 5 which are the output of the decoder circuit 10. For example, if the output of the decoder select signals 3 are changed such that the latch signals 5-*a* and 5-*b* are produced at the same timing, the display signals of the same type can be latched in the second latches 17-*a* and 17-*b*. Thus, the icons of the same type can be displayed or different icons can be displayed at the same timing. For example, an icon can be displayed on the character display area. In such a case, the output contents of the decoder select signals 3 may be changed such that one of the latch signals 5-1 to 5-n/5 is generated at timing at which the icon display signal 2 is output. The character display area can be changed to the icon display area. As a result, the matrix panel may display a complicated image. According to the second embodiment, further, characters or icons can be moved on the matrix panel, by controlling the generation timing of the latch signals 5. Such movement of characters and/or icons is made adaptable for portable telephones, for example, in such a way that a previously dialed number is pushed leftward each time another number is dialed.

Figure 13:
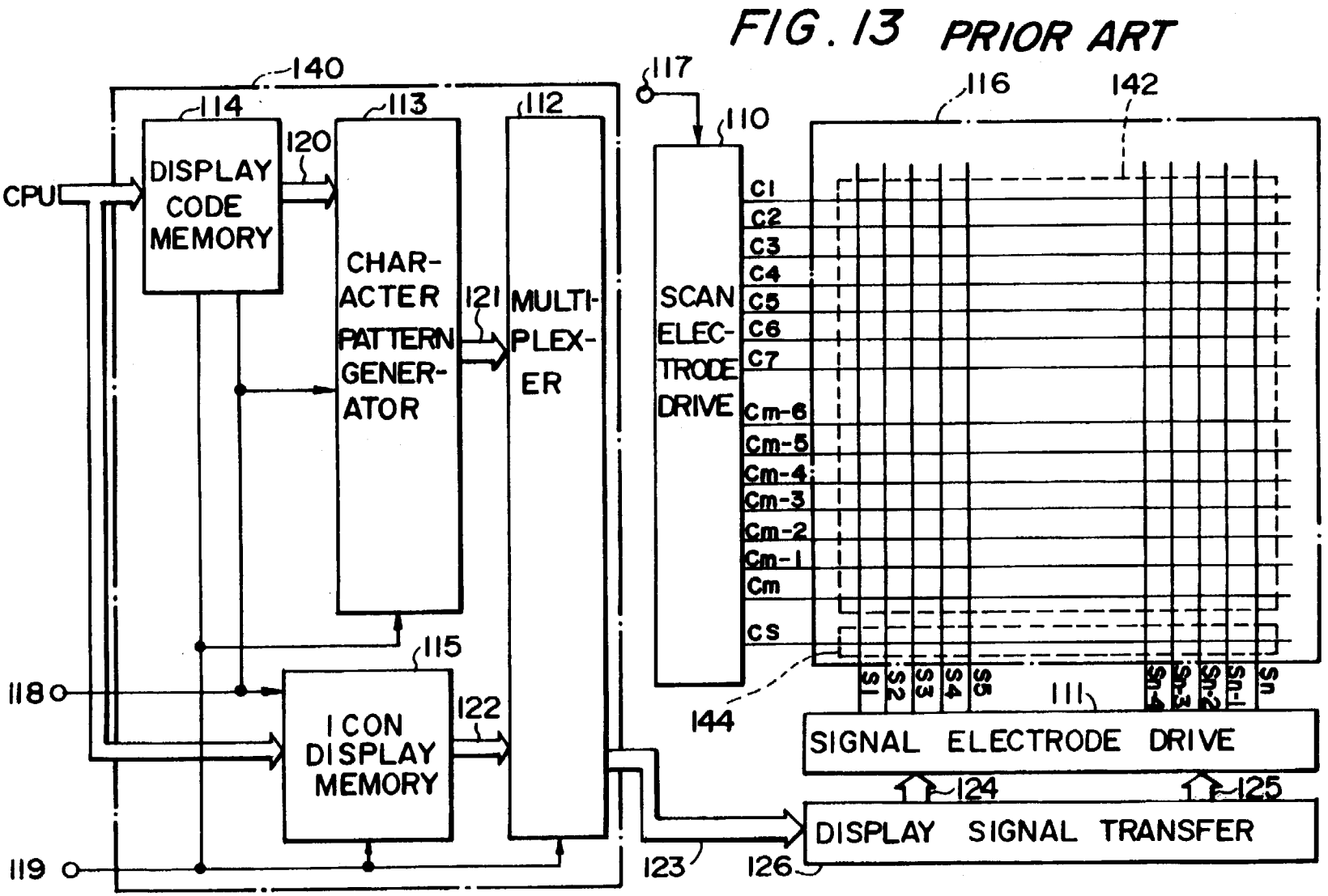
FIG. 13 PRIOR ART
FIG. 13 is a view showing a configuration of a matrix panel display device in accordance with the prior art.

The matrix type display device of the second embodiment is particularly superior as a standard device. More particularly, the configuration of character and icon display areas in the prior art device of FIG. 13 cannot be changed. On the other hand, the second embodiment can change the configuration of character and icon display areas simply by re-writing the program data in the decoder selecting means 31. Therefore, the second embodiment can provide a matrix type display device in which any desired display area can be changed voluntarily without modifying the circuit.

The second embodiment uses the display signal generating circuit which is equivalent to that of the first embodiment. Nevertheless, the present invention is not limited to such an arrangement, but may be applied to any other types of display signal generating circuits. In such a case, it is desirable that the same data format of the display signal 2 (including the number of bits, output timing and other factors) is used in both the character and icon display signals. This is because the second embodiment uses the same format and therefore configuration of character and icon display areas can be changed freely. In other words, the configuration of the display signal circuit 70 using the same format becomes optimum when combining with the display signal transferring circuit 72.

Figure 5:
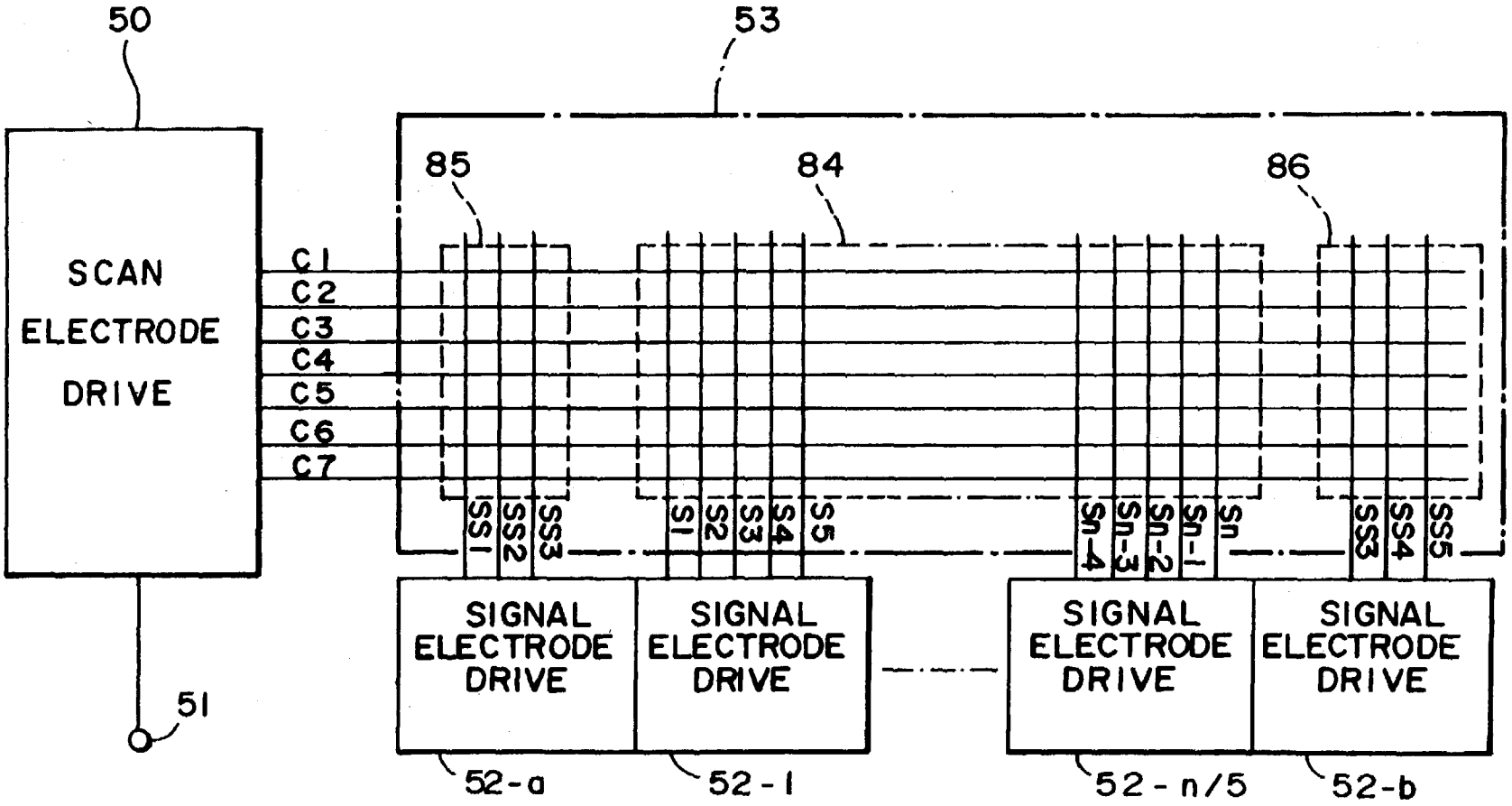
FIG. 5 is a view of an application of the second embodiment.

FIG. 5 shows an application of the second embodiment. The basic structure thereof is similar to that of the second embodiment. The structure of the reading-out of display signals extending to the outputting of the signal electrode driving circuit is omitted, since it is similar to that of the second embodiment. This application is different from the second embodiment only in that the icon display signal electrodes defining one character are divided into a group SS1–SS3 located on the left side of the character display signal electrodes S1–Sn, and another group SS3–SS5 located on the right side of the same. Signals SS1–SS5 are controlled as one-character group. Therefore, at the icon display areas 85 and 86 located on the right side and left side of the character display area 84 respectively, the same icon can be displayed through SS3 or different icons can be displayed at the same timing through SS3. In this case, the second latches 17-*a* and 17-*b* arranged at separate locations (see FIG. 3) may respond to the latch signals 5-*a* and 5-*b* output at the same timing to latch the icon display signals 2.

Figure 6:
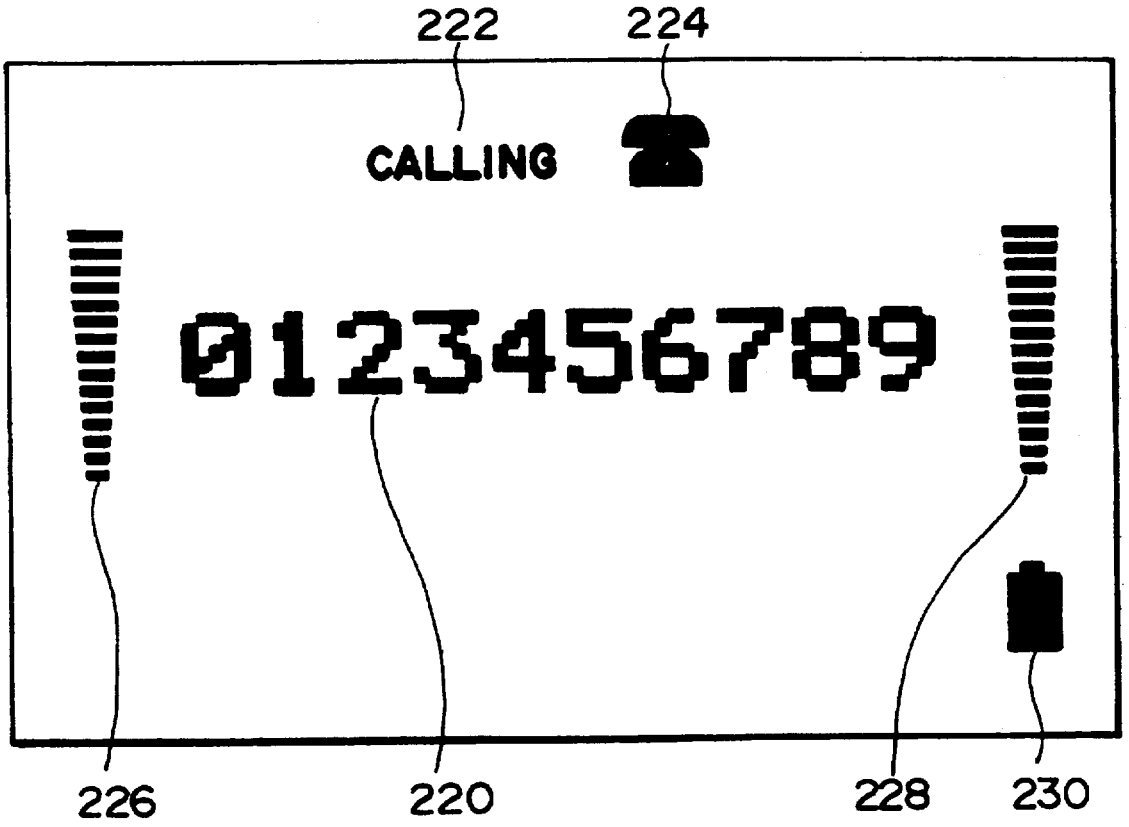
FIG. 6 is a view showing an example of the displayed image formed by the second embodiment.

FIG. 6 shows an image displayed according to the second embodiment. This scan displays characters 220 and icons 222–230. The upper part of the icon display area indicates a calling mark icon 222 and a telephone mark icon 224 while the left and right regions indicate indicator icons 226 and 228 representing the residue of the batteries. The lower part indicates a battery mark icon 230. Thus, the second embodiment can display many icons at the upper, lower, right and left of the image. It is possible to display an icon at the center of the image. According to the second embodiment, the icons 226, 228 and 230 can be displayed at the same timing, thus increasing the variety of display.

Although the display of icon at one-character group unit (e.g., five bits) is described in the second embodiment and its application, the present invention may be applied to a multi-character group unit (e.g., 10 bits). The icon display area may be located at the upper and lower regions or center not restricted to rightside and leftside. If icons are to be arranged in the upper and lower regions, two sets of scan electrodes CS1–CS5 may be disposed at the upper and lower regions of the matrix panel. An icon display area may be provided where the scan electrodes cross the signal electrodes S1, S2–Sn.

Third Embodiment

Figure 7:
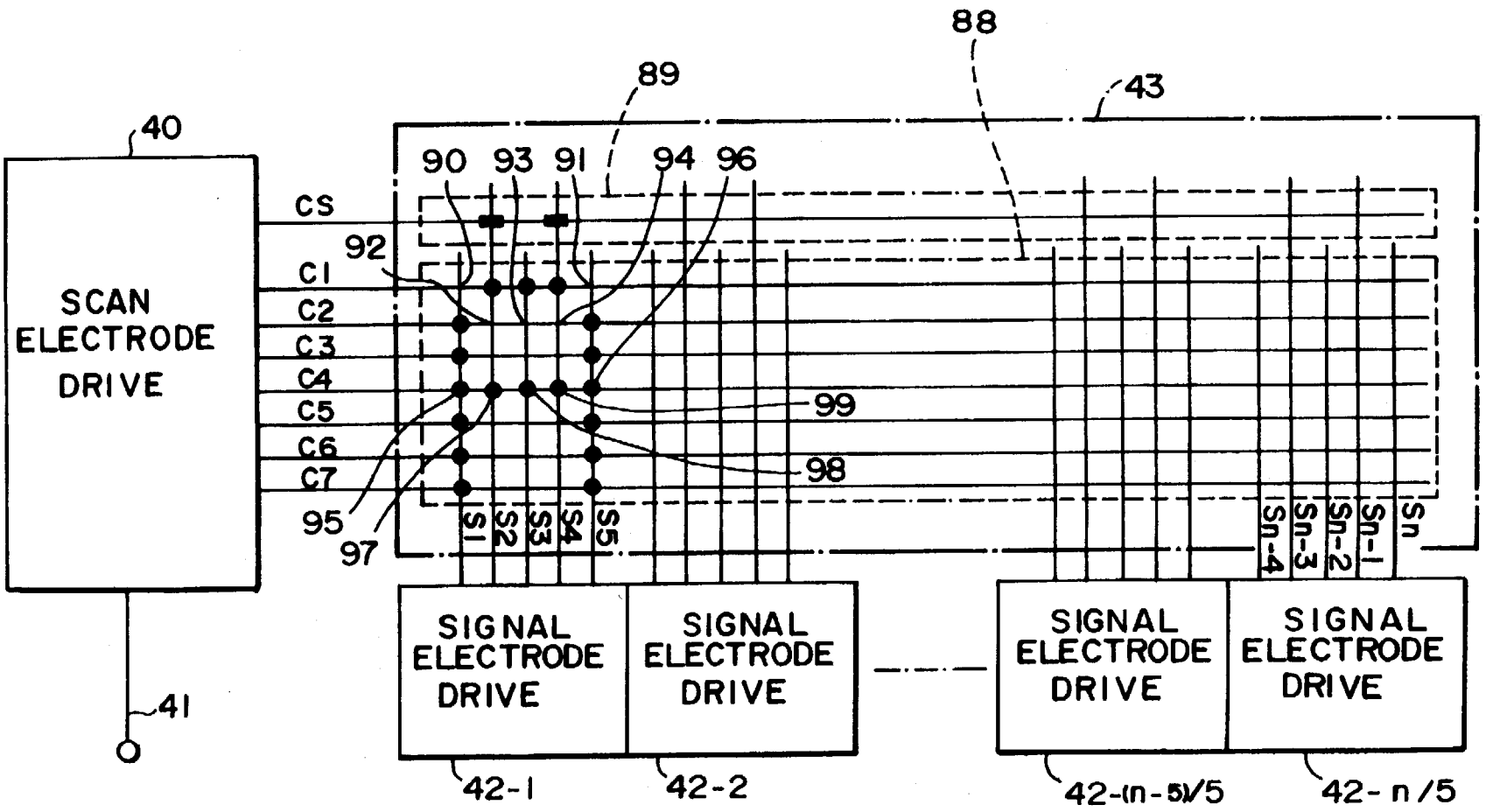
FIG. 7 is a view of a configuration of a matrix type display device of the third embodiment in accordance with the present invention.
Figure 8:
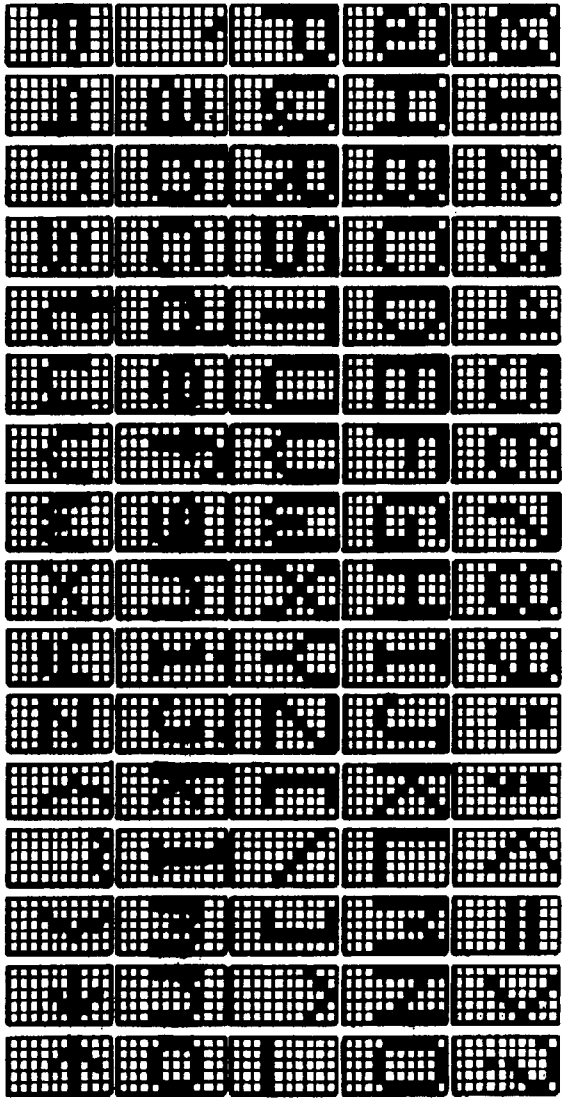
FIG. 8 shows character fonts for illustrating the third embodiment.
Figure 10:
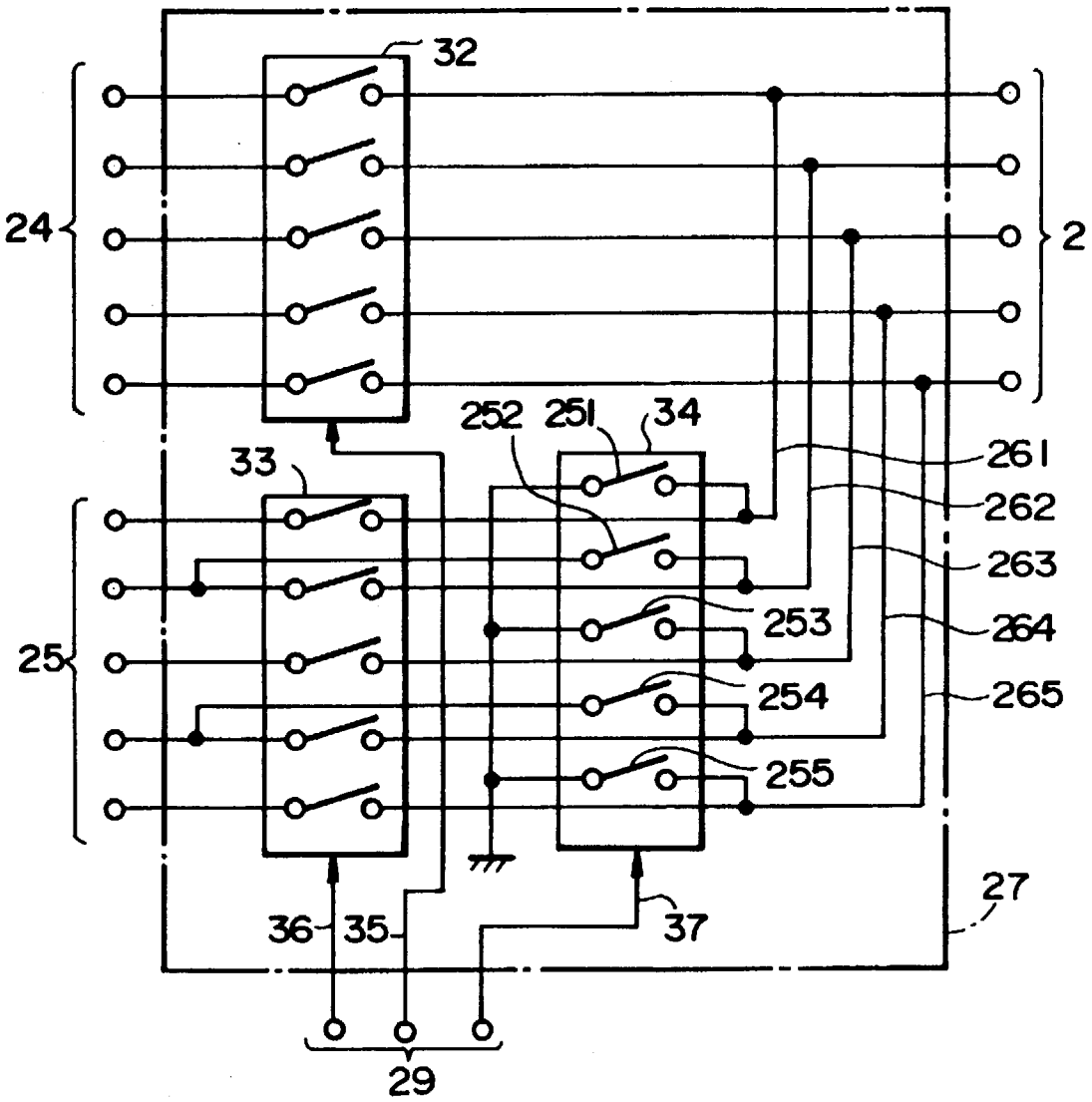
FIG. 10 is a view of a configuration of a multiplexer.

FIG. 7 shows a matrix type display device of a third embodiment according to the present invention. FIG. 8 shows the character fonts used in the third embodiment. FIGS. 9A and 9B show the rates of lighting-on. FIG. 9A shows the rates of lighting-on on the side of signal electrodes and FIG. 9B shows the rates of lighting-on on the side of scan electrodes. Further, FIG. 10 shows a configuration of a multiplexer in the third embodiment. The display signal generating circuit and display signal transferring circuit are omitted, since they are similar to those of the first and the second embodiments.

The characters are displayed on the character display area 88. In FIG. 7, a letter "A" is lighted and displayed at crossing areas between the scan electrodes C1–C7 and the signal electrodes S1-S5. On the other hand, an icon is displayed at the icon display area 89. In the third embodiment, an icon is displayed at crossing areas between the scan electrode CS disposed at the icon display area and the signal electrodes S2, S4, but not at crossing areas between the scan electrode CS and the signal electrodes S1, S3 and S5. A plurality of such scan electrodes CS may be provided. The scan electrodes may be divided into the upper and lower regions of the matrix panel.

Typical character fonts are shown in FIG. 8. The character fonts have their inherent characteristics in the character pattern display. For example, as for the letter "A" in the signal electrodes S1 and S5 six out of seven dots are lighted and in the signal electrodes S2,S3 and S4, two dots are lighted. FIG. 9A shows the rates of lighting-on in the signal electrodes S1–S5 energized when Arabic numerals 0–9, English capital letters A–Z and small letters a–z. FIG. 9B shows the rates of lighting-on in the scan electrodes C1–C7. The columns "Average" in FIGS. 9A and 9B show the average rates of lighting-on.

The rate of lighting-on for each of the Arabic numerals and English alphabet is represented by (the number of lighted dots)/(the number of dots defining one character). In this embodiment, the rate of lighting-on is the average rate of lighting-on for each character (which is a value described in each of the average columns in FIGS. 9A and 9B. It in of course that the present invention is not limited to such average rates of lighting-on, but may be applied to average rates of lighting-on for part of these characters. Alternatively, in the present invention, a value obtained when the rates of lighting-on for all the characters are multiplied by a given constant and averaged, may be used as the rates of lighting-on. Furthermore, a value obtained when the rates of lighting-on is actually measured on the panel operation, may be used as the rates of lighting-on. As is apparent from FIG. 9A, in the third embodiment, the rates of lighting-on in the signal electrodes S1, S3 and S5 are relatively high while those in the signal electrodes S2 and S4 are low.

As the difference in the rate of lighting-on between the signal electrodes or between the scan electrodes increases, a shadow phenomenon is produced mainly in the lighting-off areas and degrades the quality of display. In short, the primary cause of the shadow phenomenon is explained as follows. As the difference of potential applied to the liquid-crystal (or the rout means square value of signal) increases, the permittivity of the liquid-crystal being a display element correspondingly increases. In the lighted dots the potential difference applied to the liquid-crystal is increased and thus the permittivity of the liquid-crystal is increased. Then the parasitic capacity of the lighted dots is increased more than that of the non-lighted dots. As a result, a difference in capacity is produced between the electrodes having more lighted dots and the electrodes having less lighted dots. On the other hand, the output of the scan electrode driving circuit and signal electrode driving circuits has output impedance while the scan electrodes and signal electrodes have parasitic resistances. If it is assumed that these resistances are R and the parasitic capacities are C, the drive voltages for driving the scan electrodes and signal electrodes will be distorted from the ideal value by a time constant T=CR, and decrease their rout mean square value. As it is described, the electrodes having more lighted dots, that is, the electrodes which have higher rates of lighting-on, will have their parasitic capacity C than that of the electrodes having less lighted dots, the electrodes which have lower rates of lighting-on (thus increasing the load). As a result, the rout mean square value of the voltages for driving the electrodes having a higher rate of lighting-on decreases, creating a phenomenon called "shadow".

With a letter "A", for example, the load on the signal electrodes S1 and S5 is heavier while the load on the signal electrodes S2, S3 and S4 becomes lighter. Therefore, the rout mean square value in the signals S1 and S5 are smaller than those of S2, S3 and S4. It is now assumed that the lighted areas are black while non-lighted areas are white. If a non-lighted dot 90 at the crossing point between S1 and C1 or a non-lighted dot 91 at the crossing point between S5 and C1 is compared with non-lighted dots on S2, S3 and S4 (e.g., 92, 93 and 94), the former will be more whitish than the latter. If lighted dots on S1 and S5 (e.g., 95 and 96) are compared with lighted dots on S2, S3 and S4 (e.g., 97, 98 and 99), the former will be more whitish than the black on lighting. Namely this is called "uneven" or shadow phenomenon on the matrix panel.

According to this embodiment, the above problem is overcome by displaying an icon being a load at the crossing areas between the scan electrode CS and electrodes having a lower rate of lighting-on (e.g., signal electrodes S2 and S4 in FIG. 7). By equalizing the loads on the electrodes as much as possible in such a manner, the quality of displayed image can be improved. The display for one character has been described, the position at which icons are displayed is determined by the rates of lighting-on as described the columns "Average" in FIGS. 9A and 9B while actually considering the rates of lighting-on for a plurality of characters connected together to the signal electrodes or scan electrodes.

Although the third embodiment has been described in connection with the signal electrodes S1–S5, the present invention is not limited to this, but may similarly be applied to the scan electrodes C1–C7 by providing at least one signal electrode SS for displaying the icon. In such a case, the rates of lighting-on in the scan electrodes C2 and C6 are lower, as is apparent from FIG. 9B. The quality of display can thus be improved by providing an icon display area in the crossing areas between the scan electrodes C2, C6 and the signal electrode SS.

In connection with FIG. 10, the multiplexer 27 in the display signal generating circuit 74 will be described in detail. The multiplexer 27 comprises selecting circuits 32, 33 and 34. The selecting circuit 32 receives a display pattern signal 24 from the CGROM; the selecting circuit 33 receives a display pattern signal 25 from the CGRAM; and the selecting circuit 34 receives the output of the selecting circuit 33. A select signal 29 includes a CGROM select signal 35, a character pattern display CGRAM select signal 36 and an icon display CGRAM select signal 37. These signals are input into the selecting circuits 32, 33 and 34, respectively. Signals selected by these selecting circuits 32, 33 and 34 are then output from the multiplexer 27 as the display signal 2.

When the icon display CGRAM select signal 37 becomes active in the selecting circuit 34, and closes switches 251–255, display signals 262 and 264 corresponding to S2 and S4 pass through the switches while display signals 261, 263 and 265 corresponding to S1, S3 and S5 are fixed to GND potential. The icon display CGRAM select signal 37 may become active, for example, when the icon display scan electrode CS is selected in FIG. 7. If S1, S3 and S5 are fixed to GND potential at this time, no icon is displayed at the crossing areas between S1, S3 and S5 and CS. On the other hand, an icon will be displayed at the crossing areas between S2 and S4 and CS as usual. Thus, these display signals can be fixed to GND level without Performing such a writing operation through CPU or the like that the display signals corresponding to S1, S3 and S5 become GND level.

Figure 11:
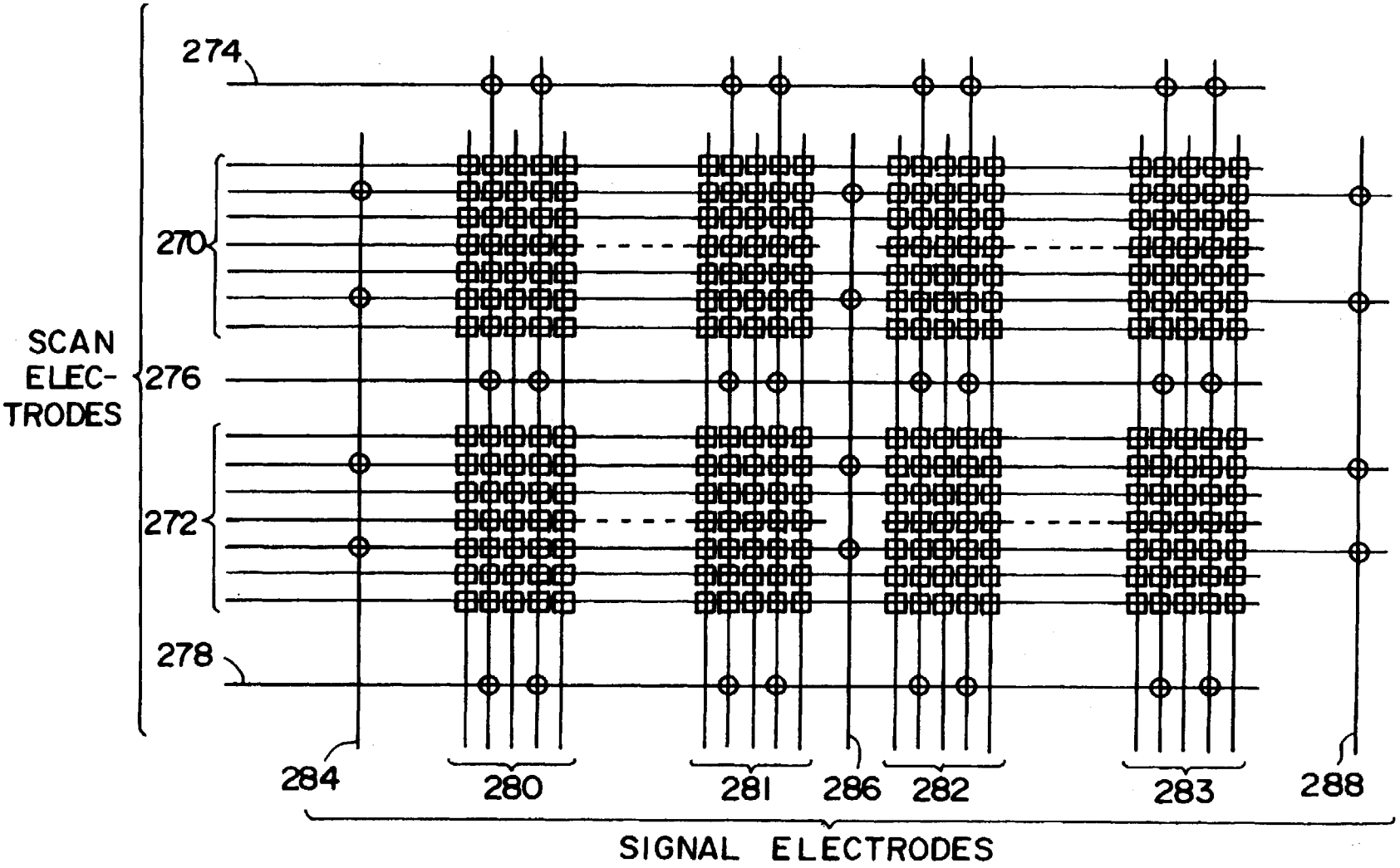
FIG. 11 is a view illustrating a configuration of character and icon displays according to the present invention.

FIG. 11 shows a configuration of character and icon displays according to the present invention. In this figure, circles represent icon display while squares represent character display. Character scan electrodes 270 and 272 and icon scan electrodes 274, 276 and 278 are provided. Also, provided character signal electrodes 280, 281, 282 and 283 and icon signal electrodes 284, 286 and 288 are provided. Thus, icons can be displayed at upper, lower and left and right regions and the character display area of the matrix panel. The icons are displayed on scan electrodes and signal electrodes having lower rate of lighting-on and reduced load, thus improving the quality of display.

Figure 12:
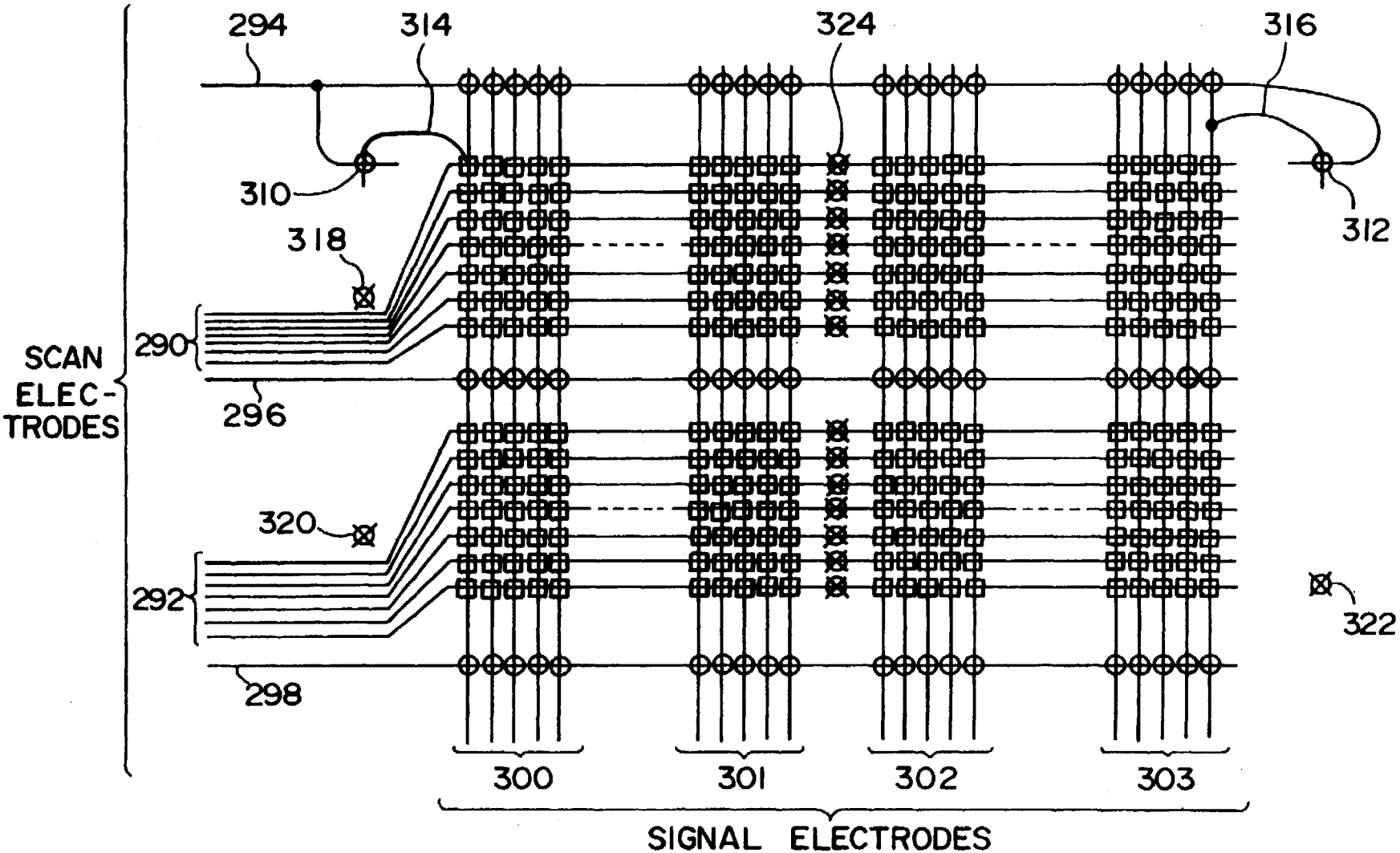
FIG. 12 is a view illustrating a configuration of character and icon displays according to the prior art.

FIG. 12 shows a configuration of character and icon displays according to the prior art. As shown in FIG. 12, the positions of the prior art at which the icons are displayed are independent of the rate of lighting-on in the electrodes. Therefore, the shadow phenomenon is created and thus degrades the quality of display. The prior art comprises character scan electrodes 290 and 292 and icon scan electrodes 294, 296 and 298, but does not comprise any icon signal electrode other than character signal electrodes 300, 301, 302 and 303. Therefore, it is difficult to display icons on the left and right display areas. In addition, it is substantially impossible to display an icon in the character display area. More particularly, the icons can be displayed on areas 310 and 312 by crossing the scan electrode 294 and the signal electrode 314 or the scan electrode 294 and the signal electrode 316. However, no icon can be displayed on an area 318 since the scan electrode cannot cause to cross with the signal electrode by obstruction from the character scan electrode 290. No icon can be also displayed on areas 320 and 322 since the electrodes are extended, and thus the parasitic resistance becomes too great. It is substantially impossible to display the icons on an area 324 since the icon scan electrode and the signal electrode do not cross. The present invention can not only improve the quality of display, but also perform the icon display which would be difficult or impossible in the prior art.

The present invention is not limited to the aforementioned embodiment, but may similarly be applied in various modifications within the scope of the invention.

For example, the configurations of the pattern generating circuit, signal electrode driving circuit, line memory, latch circuit, decoder circuit and decoder selecting circuit are not limited to those of the aforementioned embodiments, but may take various other forms.

Also, the type of displayed icons and the layout of character and icon display areas are not limited to those of the aforementioned embodiments, but may take various types and forms.

We claim:

1. An electronic system comprising a matrix type display device comprising a matrix panel including display pixels arranged in a matrix and a plurality of signal electrodes crossing with a plurality of scan electrodes, signal electrode driving means for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, means for displaying an icon on said matrix panel at a crossing area between one of the signal electrodes having a lower rate of lighting-on when a character is displayed at the character display area and one of the scan electrodes disposed at the icon display area.

2. An electronic system comprising a matrix type display device as defined in claim 1, said system displaying a desired image including characters and icons on said matrix panel.

3. An electronic system comprising a matrix type display device comprising a matrix panel including display pixels arranged in a matrix and a plurality of signal electrodes crossing with a plurality of scan electrodes, signal electrode driving means for applying drive voltages to the signal electrodes of said matrix panel, scan electrode driving means for applying drive voltages to the scan electrodes of said matrix panel, means for generating a display signal for character and icon pattern and means for transferring said display signal to said signal electrode driving means, means for displaying an icon on said matrix panel at a crossing area between one of the scan electrodes having a lower rate of lighting-on when a character is displayed at the character display area and one of the signal electrodes disposed at the icon display area.

4. An electronic system comprising a matrix type display device as defined in claim 3, said system displaying a desired image including characters and icons on said matrix panel.

5. A method of driving display pixels, comprising the steps of arranging display pixels in a matrix on a matrix panel, arranging a plurality of signal electrodes crossing a plurality of scan electrodes, applying drive voltages to said signal electrodes from signal electrode driving means, applying drive voltages to said scan electrodes from scan electrode driving means, generating a display signal for character and icon pattern and transferring said display signal to said signal electrode driving means, a step of displaying an icon on said matrix panel at a crossing area between one of the signal electrodes having a lower rate of lighting-on when a character is displayed at the character display area and one of scan electrodes disposed at the icon display area.

6. A method of driving display pixels, comprising the steps of arranging display pixels in a matrix on a matrix panel, arranging a plurality of signal electrodes crossing a plurality of scan electrodes, applying drive voltages to said signal electrodes from signal electrode driving means, applying drive voltages to said scan electrodes from scan electrode driving means, generating a display signal for character and icon pattern and transferring said display signal to said signal electrode driving means, a step of displaying an icon on said matrix panel at a crossing area between one of the scan electrodes having a lower rate of lighting-on when a character is displayed at the character display area and one of the signal electrodes disposed at the icon display area.

* * * * *